United States Patent [19]

Boyd

[11] Patent Number: 5,071,203

[45] Date of Patent: Dec. 10, 1991

[54] ENVIRONMENTAL HOUSING FOR SUPPORTING VIDEO MONITOR OUTDOORS

[76] Inventor: Donald F. Boyd, 1807 Brushy Creek Dr., Sugarland, Tex. 77578

[21] Appl. No.: 538,987

[22] Filed: Jun. 15, 1990

[51] Int. Cl.[5] ..... A47B 5/00

[52] U.S. Cl. ..... 312/7.2; 312/102; 312/229

[58] Field of Search ..... 312/213, 102, 229, 7.2

[56] References Cited

U.S. PATENT DOCUMENTS

| | | | |
|---|---|---|---|
| 2,514,001 | 7/1950 | Knuth | 312/213 |
| 2,588,612 | 3/1952 | Brookins | 312/229 X |
| 3,063,766 | 11/1962 | Goehl | 312/213 X |
| 3,363,953 | 1/1968 | Lacan | 312/229 X |
| 4,787,687 | 11/1988 | Merl | 312/100 |
| 4,846,537 | 7/1989 | Cohn et al. | 312/229 |

*Primary Examiner*—Joseph Falk

*Attorney, Agent, or Firm*—David H. Judson

[57] ABSTRACT

An environmental housing is described and is especially adapted for supporting a video monitor outdoors in connection with a video merchandising system. The video merchandising system advantageously provides point-of-purchase advertising and promotion of various goods or services as a retail establishment such as a gasoline service station. The housing preferably comprises a substantially rectangular cabinet having first and second sides, a top, a bottom and a back. A door is attached to the cabinet and includes a chemically-treated glare-resistant window. A video monitor is supported in the cabinet for displaying television commercials or like programming material under the control of the merchandising system. The housing includes a vent slot in at least one of the sides or back of the cabinet for venting the inside of the cabinet and substantially preventing water from entering the cabinet.

6 Claims, 3 Drawing Sheets

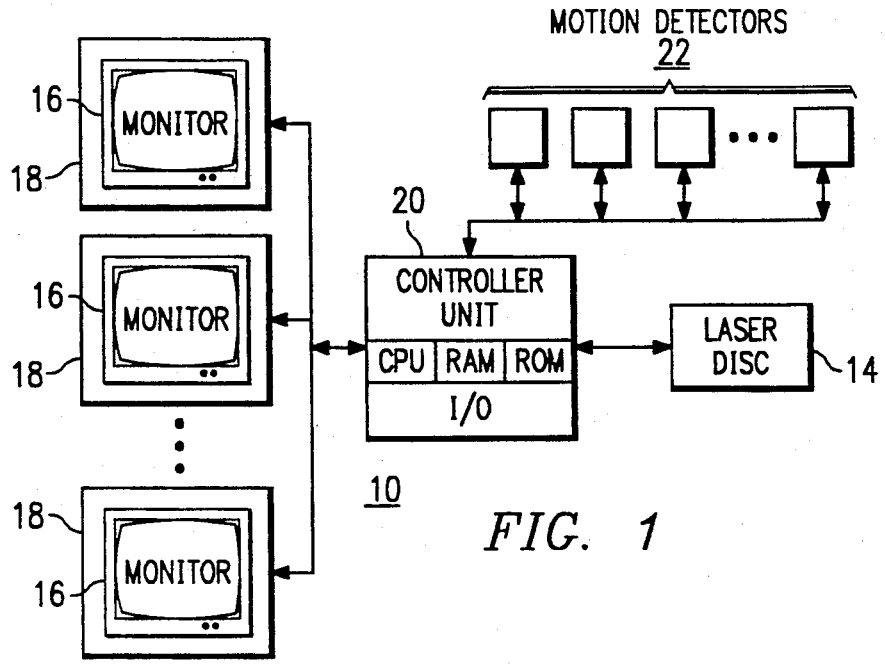
FIG. 1
FIG. 2
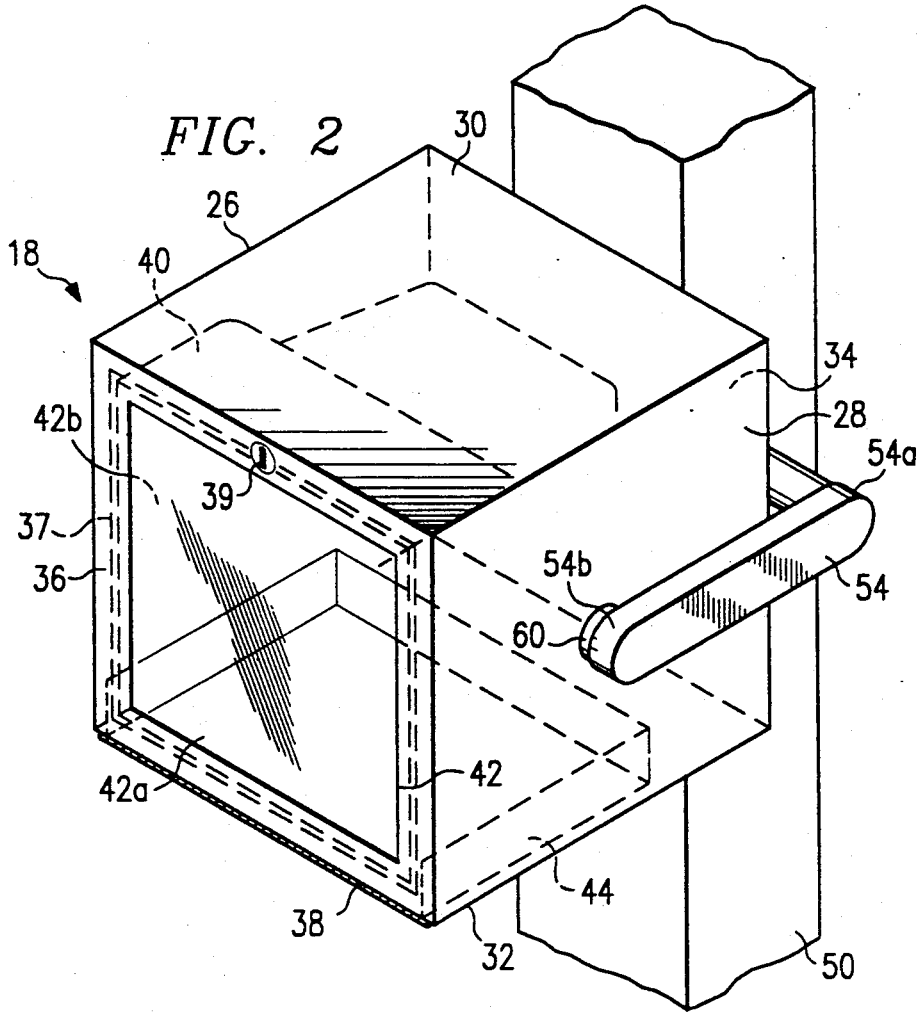

ENVIRONMENTAL HOUSING FOR SUPPORTING VIDEO MONITOR OUTDOORS

TECHNICAL FIELD

The present invention relates generally to structures for supporting video monitors or the like and more particularly to an environmental housing preferably for use in an outdoor video merchandising system to support a video monitor in unfavorable weather conditions.

BACKGROUND OF THE INVENTION

It would be desirable to provide a video merchandising system for use in an outdoor environment to facilitate point-of-purchase advertising of various products and services. It has heretofore been impractical to provide such a system outdoors, such as in a gasoline service station, because of the difficulty in supporting the complex electronics of a video monitor in unfavorable weather conditions. Even if this difficulty could be overcome, it would still be undesirable to provide an outdoor video merchandising system because of the problems in viewing a conventional television screen in ambient sunlight.

It would therefore be desirable to provide an environmental housing especially adapted to support a video display monitor outdoors to facilitate a video merchandising system for point-of-purchase advertisement and/or promotion of various products and services.

BRIEF SUMMARY OF THE INVENTION

It is an object of the present invention to provide an environmental housing for supporting a video monitor outdoors.

It is yet another object of the present invention to provide a video merchandising system that includes a unique environmental housing for supporting a video monitor under adverse or unfavorable weather conditions.

It is still another feature of the present invention to provide a rain-tight, yet fully-vented housing for supporting complex electronic components under adverse weather conditions.

These and other objects of the invention are provided in an environmental housing especially adapted for supporting a video monitor outdoors as part of a video merchandising system. Preferably, the video merchandising system advantageously provides point-of-purchase advertising and/or promotion of various goods or services as a retail establishment such as a gasoline service station. The housing preferably comprises a substantially rectangular cabinet having first and second sides, a top, a bottom and a back. A door is attached to the cabinet and includes a chemically-treated glare-resistant plexiglass window. A video monitor is supported in the cabinet for displaying television commercials or like programming material under the control of the merchandising system. The housing includes a unique vent construction that cooperates with a vent slot in at least one of the sides or back of the cabinet for venting the inside of the cabinet while substantially preventing water from entering the cabinet.

The foregoing has outlined some of the more pertinent objects of the present invention. These objects should be construed to be merely illustrative of some of the more prominent features and applications of the invention. Many other beneficial results can be attained by applying the disclosed invention in a different manner of modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which:

FIG. 1 is a schematic diagram of a video merchandising system according to the present invention;

FIG. 2 is a perspective view of an environmental housing of the video merchandising system of FIG. 1 in accordance with the teachings of the present invention;

Similar reference characters refer to similar parts throughout the several views of the drawings.

DETAILED DESCRIPTION

Figure 3:
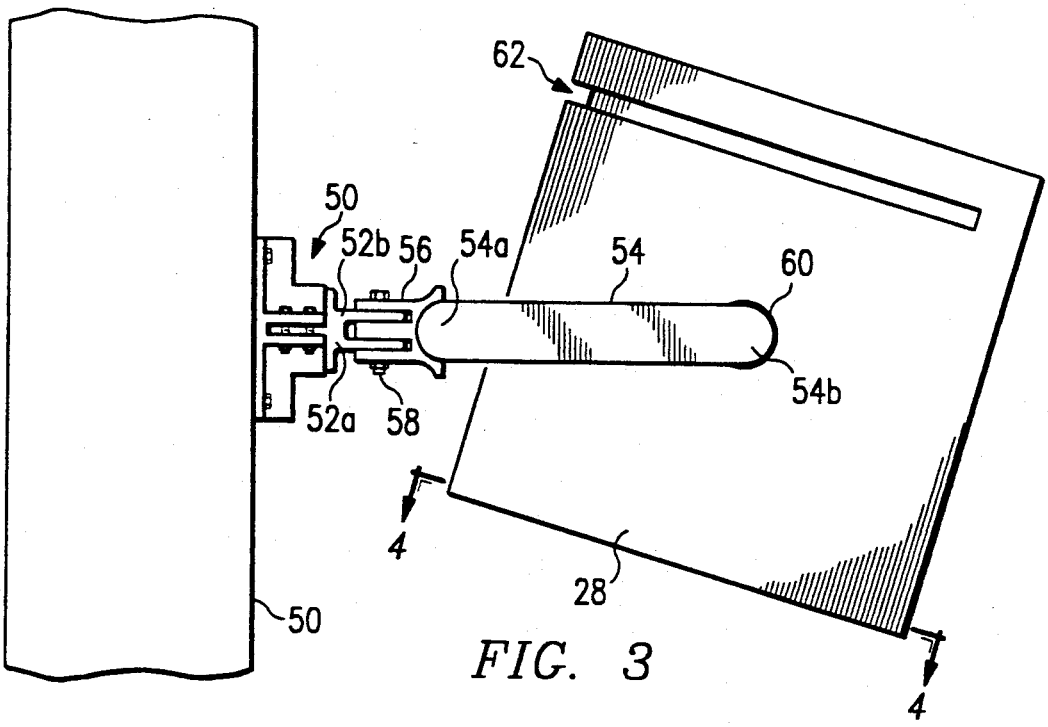
FIG. 3 is a perspective view of the environmental housing of FIG. 2 showing how the housing is supported on a support post.

FIG. 1 is a schematic diagram of a video merchandising system 10 incorporating the environmental housing of the present invention. The system 10 is designed to promote the sale of any product or service through point-of-purchase television commercials displayed at various types of retail establishments, e.g., petroleum convenience stores. As will be described in more detail below, the housing is designed for installation outdoors, for example, on a support post adjacent self-service gasoline dispensers, to provide customers of the station with a clear view of the commercials.

The system 10 preferably includes a programmable laser disc player 14 that incorporates a disc on which the various television commercials are pre-recorded. Other suitable players (such as videocassette players) may also be employed in the system. A plurality of high-resolution color monitors 16 are preferably supported on pre-existing support posts of the station for displaying the commercials. Each monitor 16 is supported in an environmental housing 18 which as described below protects all working components from any unfavorable weather conditions and facilitates clear viewing of the commercials even under sunny, high glare conditions. The system further includes a controller unit 20 that controls the overall operation of the system.

The controller unit includes suitable input/output devices to enable the sequence of the commercials to be programmed and/or certain of the commercials to be skipped and/or repeated under the control of the store operator. Controller unit 20, preferably a personal computer or the like, is connected to the laser disc player and the color monitors, as well as to one or more motion detectors 22. The motion detectors determine if a vehicle is in and/or approaching the service island. Although not meant to be limiting, preferably the controller unit 20 mutes the audio portion of the commercials until the motion detectors detect the presence of the vehicle in the island. Controller unit 20 also includes appropriate circuitry for monitoring ambient noise levels and automatically adjusting the volume of the audio output(s) from the monitors accordingly. The monitor may have its own speakers and/or one or more externally-mounted speakers are provided for the audio output. Although not shown, the speakers may also be mounted in the housing separate from the monitor itself.

Referring now to FIG. 2, a perspective view is shown of the preferred embodiment of the environmental housing 18 used to support each monitor 16. As seen in FIG. 2, housing 18 is especially adapted to be supported on a support post 24 of the service station normally just above the customer's line-of-sight. Housing 18 is preferably formed of a galvanized, rustproof steel or the like in an integral enclosure or with welded or bolted panels. The housing is painted or otherwise treated with an ultraviolet (UV) resistant paint or coating to minimize wear due to sunlight. Housing 18 comprises a substantially rectangular cabinet 25 having first and second sides 26 and 28, a top 30, a bottom 32 and a back 34. A door 36 is attached to the cabinet by hinge 38 and thus can be opened to facilitate installation, maintenance and removal of a video monitor 40 (shown in phantom). A gasket 37 is mounted in a ledge portion (not shown) of each of the panels 26, 28, 30 and 32 such that a weather-tight seal exists when the door 36 is closed. Door 36 includes a conventional heavy-duty lock 39 to prevent unauthorized entry into the cabinet. Of course, hinge 38 can be supported along the top of the cabinet or alternatively along one of the sides. Hinge 38 may also be any other type of suitable attaching means for enabling the door to be pivoted about the remainder of the housing. If desired, the door can be replaced with a fixed or semi-permanent panel with some other panel (e.g., the back panel) then being used as a door for the cabinet; alternatively, the door can be some smaller portion of one of the fixed panels if the monitor is significantly smaller than the remainder of the housing.

Door 36 includes a plate of plexiglass 42 which, according to the present invention, is chemically-treated in a unique manner to reduce glare. The plexiglass window includes a front portion **42*a* facing out from the cabinet and thus susceptible to the weather elements, and a back portion 42*b* facing into the remainder of the cabinet. Although not meant to be limiting, preferably both the front and back portions 42*a* and 42*b* of the plexiglass 42 in the door 36 are treated with a glare reducing composition that serves to diffuse direct and indirect light contacting the glass. The preferred composition is a clear lacquer-based spray marketed under the name GLAREFREE TM by AMSC, Inc. of Altamonte Springs, Fla. Although not meant to be limiting, this product consists essentially of between about 10–12% by weight lacquer, between about 50–58% by weight xylene, up to about 5% by weight methyl isobutyl ketone, and the remainder mixed solvents. Preferably, the front portion 42*a* is sprayed with a composition consisting essentially of 11% by weight lacquer, 54% by weight xylene, 5% by weight ketone and the remainder (30% by weight) being mixed solvents. The back portion preferably is sprayed with a slightly-modified composition such as 12% by weight lacquer, 58% by weight xylene, 5% by weight ketone and the remainder (25% by weight) mixed solvents. Preferably, the composition is sprayed on the glass in a circular motion with the thickness of the coating being greatest in and around the center of the plexiglass. The coating thickness decreases towards the edges of the glass. Such application of the composition produces excellant results due to the curvature of the cathode ray tube of the video monitor 40**. The treated glass is then dried and buffed.

While plexiglass is the preferred material for element 42, conventional glass or other suitable glass-based compositions can likewise be used. Plexiglass provides significant advantages because of its durability and hardness.

The housing 18 further includes a ledge 44 secured to the bottom 32 (and/or one or both of the sides 26 and 28) for supporting the video monitor. The position of the ledge relative to the bottom 32 of the cabinet depends on the size of the video monitor 40.

Referring now simultaneously to FIGS. 2 and 3, the preferred means for supporting the cabinet to a support post 50 of the service station island is shown. The environmental housing includes a reinforced mounting base 52 having a pair of support legs **52*a* and 52*b* extending therefrom. The mounting base 52 is secured to the pole, which is generally square in cross-section, by one or more conventional fasteners. Although not shown in detail, the mounting base 52 can be attached to one or more stainless steel bands for securing the housing to a round pole. A support arm 54 is coupled to the mounting base by a coupling 56 which cooperates with the support legs 52*a* and 52*b* and a threaded fastener 58. The coupling and thus the support arm can thus be pivoted side-to-side by loosening the fastener and rotating the coupling and support arm relative to the support legs. The fastener 58** clamps the support arm in place once the final position for the cabinet is determined.

Support arm 54 is preferably hollow for supporting the electrical wires (including power and audio/video signaling) for the video monitor. A first end **54*a* of the support arm is integrally formed with or attached to the coupling 56. The second end 54*b* of the support arm is rotatably attached to a coupling 60 in the side 28. The cabinet can thus be tilted and locked in place by rotating the coupling 60 relative to the support arm or vice versa. Of course, the placement of the support arm relative to the cabinet can be varied depending on the specific physical installation involved, however, the placement shown in FIG. 2 and 3** is preferred.

Figure 3A:
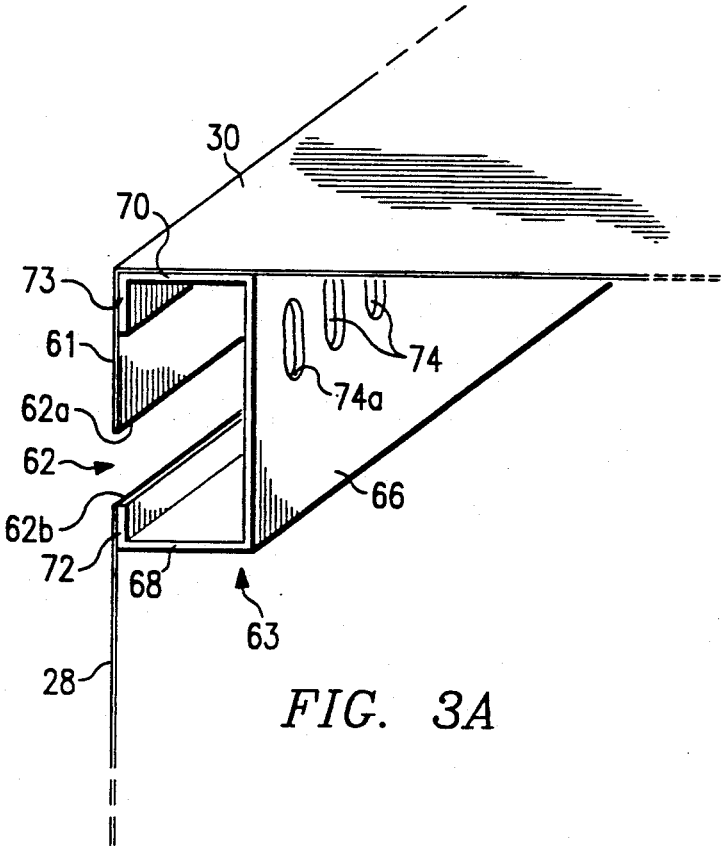
FIG. 3A is a detailed cross-sectional view showing the construction of one of vents of the housing.

According to a feature of the present invention, the environmental housing includes means for venting the interior of the cabinet while simultaneously preventing rain or other moisture from entering the housing and damaging the electrical components therein or creating safety hazards. As seen in FIG. 3, preferably at least one of the sides 28 and/or back 34 of the cabinet include a vent slot 62 adjacent the top 30 of the cabinet for this purpose As best seen in FIG. 3A, each vent slot 62 includes a top edge **62*a* and a bottom edge 62*b* and extends generally parallel to the top 30. The vent slot 62 thus extends parallel to the top 30 and is spaced therefrom by a portion 61 of the side located between the top and the edge 62*a*, the portion serving to cause water from the top to drain outwardly of the slot. A substantially u-shaped channel member 63 is welded or otherwise attached to an inside wall of the side and/or back. In particular, u-shaped channel member includes a base 66 parallel to the side portion 61, first and second sides 68 and 70 extending from the base 66, an edge 72 extending from the first side 68, and an edge extending from the second side 70. A plurality of vertically-extending holes 74 are cut into the surface of the base 66. The bottom 74*a* of each hole 74 is located at or above the top edge 62*a* of the vent slot 62**. The placement of the u-shaped channel member relative to the vent slot insures that rain water must essentially defy gravity to enter the interior of the cabinet. The structure of the vent slot and the associated channel member, however, facilitates air flow throughout the cabinet and thus simultaneously provides venting and splashproofing.

Figure 4:
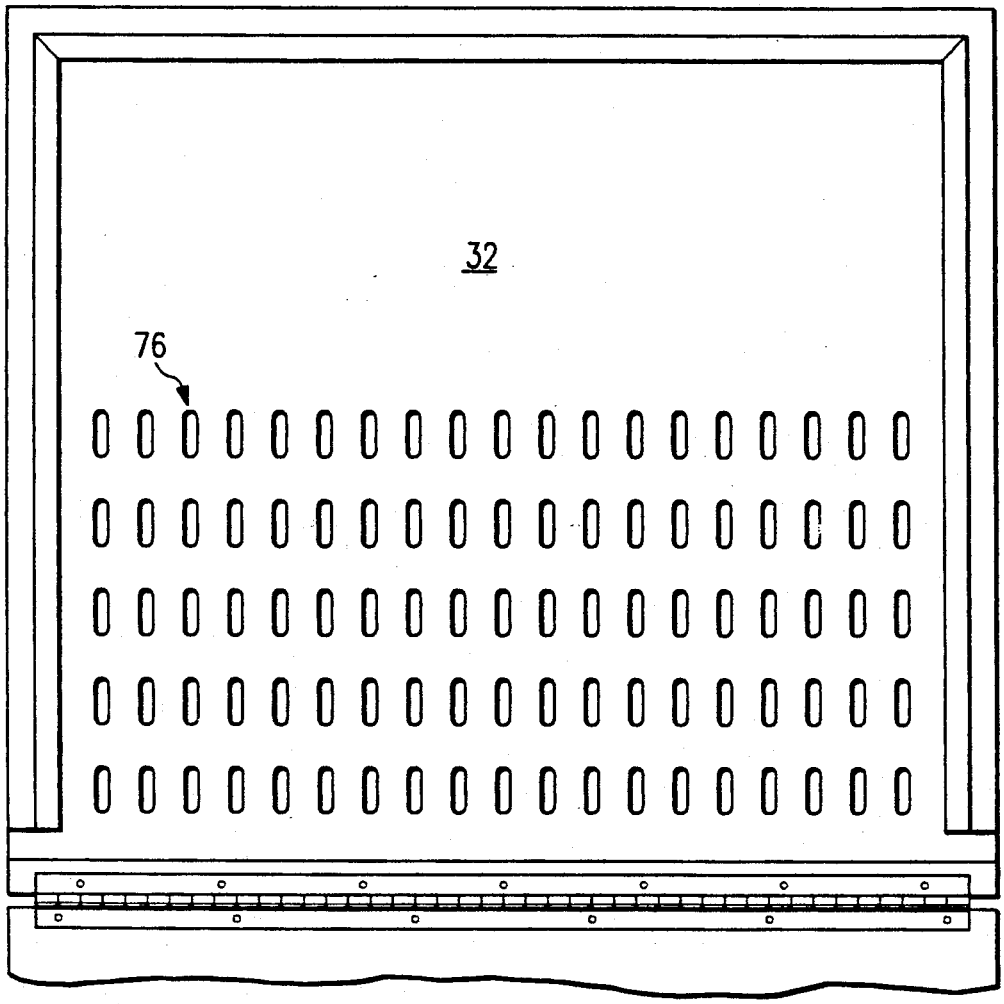
FIG. 4 is a top view along lines 4—4' of FIG. 3 showing the construction of the bottom of the housing.

As seen in FIG. 4, the bottom 32 of the cabinet includes a plurality of vent holes 66 to enable drainage of any water that might collect in the cabinet. The vent holes 76 also provide increased airflow through the entire housing, thereby improving ventilation.

The environmental housing described above has significant advantages. The housing conveniently supports a video monitor for outdoor viewing. The use of glare-reducing material on the front and back portions of the glass significantly reduces glare and facilitates viewing of the commercials or other program material even in bright sunshine. The unique vent structure in the housing allows the monitor to be operated efficiently and without overheating while at the same time substantially prevents water from entering the housing. The housing is extremely reliable due to the watertightness of the construction and the use of strong durable materials such as plexiglass and rust-proofed galvanized steel.

The housing thus advantageously enables the providing of a video merchandising system for advertising and/or promoting various good and services in a point-of-purchase or other manner. Although the present invention has been described in connection with point-of-purchase advertising and/or promotion, it should be appreciated that any type of program material can be displayed by the video monitor. Thus the teachings of this invention are not limited to a video merchandising system. The housing can support a video monitor displaying entertainment programming for persons waiting in line to enter a movie theatre or the like, or the monitor can be used to display information such as flight schedules or the like if the housing is located at an airport.

It should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

I claim:

1. An environmental housing especially adapted for supporting a video monitor outdoors, comprising:

a substantially rectangular cabinet having first and second sides, a top, a bottom and a back;

a door attached to the cabinet, the door including a window coated with a glare-reducing coating;

means within the cabinet for supporting the video monitor;

a vent slot in a side of the cabinet, the vent slot extending parallel to the top and being spaced therefrom by a portion of the side, said side portion causing water from the top to drain outwardly of the slot; and a substantially u-shaped channel member within the housing and adjacent said vent slot, the channel member having a base parallel to the side portion and including a plurality of holes for enabling air to flow into and out of the cabinet.

2. The environmental housing as described in claim 1 wherein the bottom includes a plurality of vents for drainage.

3. The environmental housing as described in claim 1 wherein the housing further includes means for supporting the cabinet in a free-standing manner from a support post.

4. The environmental housing as described in claim 3 wherein the means for supporting the cabinet includes at least one support arm having adjustment means for tilting and locking the cabinet relative to the support arm.

5. The environmental housing as described in claim 4 wherein the support arm is substantially hollow to support electrical wires of the video monitor.

6. The environmental housing as described in claim 4 wherein the means for supporting the cabinet further includes a support post mounting bracket and means for supporting the support arm for side-to-side movement relative to the support post mounting bracket.

* * * * *